US006123894A

United States Patent [19]

Van Laar et al.

[11] Patent Number: 6,123,894

[45] Date of Patent: Sep. 26, 2000

[54] RUNNER FOR GUIDING A FLOW OF LIQUID METAL

[75] Inventors: Jacobus Van Laar, Ge Driehuis, Netherlands; Floris Ronald Van Laar, Burlington, Canada

[73] Assignee: Hoogovens Technical Services Europe BV, IJmuiden, Netherlands

[21] Appl. No.: 09/217,834

[22] Filed: Dec. 22, 1998

[30] Foreign Application Priority Data

Dec. 23, 1997 [NL] Netherlands ..... 1007881

[51] Int. Cl.[7] ..... C21B 7/10

[52] U.S. Cl. ..... 266/192; 266/196

[58] Field of Search ..... 266/46, 191, 196, 266/192

[56] References Cited

U.S. PATENT DOCUMENTS

| | | | |
|---|---|---|---|
| 1,881,228 | 10/1932 | Pape | 266/191 |
| 3,587,198 | 6/1971 | Hensel . | |
| 4,426,067 | 1/1984 | Hopkins | 266/191 |
| 4,508,323 | 4/1985 | Fleming . | |
| 5,031,882 | 7/1991 | van Laar et al. | 266/196 |

FOREIGN PATENT DOCUMENTS

| | | |
|---|---|---|
| 00060239 | 9/1982 | European Pat. Off. . |
| 00076577 | 4/1983 | European Pat. Off. . |
| 56-087612 | 7/1981 | Japan . |
| 62-156213 | 7/1987 | Japan . |

*Primary Examiner*—Scott Kastler
*Attorney, Agent, or Firm*—Stevens, Davis, Miller & Mosher, L.L.P.

[57] ABSTRACT

Runner for guiding a flow of liquid metal and/or slag, comprising a refractory permanent lining and, inside the latter, a refractory wear lining, in which runner the permanent lining is arranged inside an elongate trough-like steel casing, in which parallel runner ducts through which a gaseous cooling medium is passed run through this permanent lining divided along the circumference and in the vicinity of the bottom and the walls of the steel casing, and in which the wearing and the permanent lining are separated from one another by a deformable layer which is made from the group of materials comprising dry refractory ramming mixture and refractory felt.

9 Claims, 1 Drawing Sheet

RUNNER FOR GUIDING A FLOW OF LIQUID METAL

The invention relates to a runner for guiding a flow of liquid metal and/or slag, comprising a refractory permanent lining and, inside the latter, a refractory wear lining. Runners of this nature are used, for example, in blast furnaces. In this application, after the blast furnace has been tapped, the liquid iron which is produced therein is lining through a runner to a ladle or a transport vehicle for liquid iron.

A layer of liquid slag, which while moving through the runner is separated from the iron and is lining to a separate ladle, floats on the liquid iron.

Runners of the type described are subject to considerable thermal shocks, to the aggressive action of the molten iron and the molten slag, and to abrasion caused by the flows of iron and slag which are passing through at high speeds. For this reason, there is a need for runner structures which have a long service life and which are simple to repair.

In general, in the runner structure, part of its lining is designed as a so-called permanent lining, and another part is designed as the so-called wear lining. The intention in so doing is for the wear lining, which becomes damaged over the course of time, to be replaced in its entirety, while the permanent lining is designed so that it is able to last for a long time. To achieve this, it is important for there to be no possibility of damage to the permanent lining as a result of mechanical wear, thermal stresses or chemical attacks.

According to the invention, a considerable improvement to the known runner structure is achieved by the fact that the permanent lining is arranged inside an elongate trough-like steel casing, in that parallel ducts through which a gaseous cooling medium is passed run through this permanent lining divided along the circumference and in the vicinity of the bottom and the walls of the steel casing and in that the wear lining and the permanent lining are separated from one another by a deformable layer which is made from the group of materials comprising dry refractory ramming mixture and refractory felt. The advantage of this structure has been found to consist in the fact that the cooling inside the steel casing which it allows maintains this steel casing at a more or less uniform low temperature throughout the entire working life of the runner. Consequently, the steel casing is able to maintain a very high dimensional stability, so that the permanent lining is not subject to external stresses caused by deformations in the steel casing. Without this dimensional stability of the steel casing, deformations, cracks and open fissures may be formed in the refractory lining of the runner. These problems considerably increase the risk of the steel breaking through the runner.

A further protection for the permanent lining in the novel structure of the runner is obtained if the wear lining and the permanent lining are separated from one another by a deformable layer which is made from the group of materials comprising dry refractory ramming mixture and refractory felt. As a result, if the temperature of the wear lining increases considerably as a result of the liquid iron flowing through it, a thermal expansion of this wear lining can be absorbed by the deformable layer. This layer then serves both as an expansion joint and as a sliding joint. The permanent lining is consequently also provided with mechanical protection against the expansion of the wear lining.

It should be noted that if the temperature of the wear lining increases considerably, the material of the deformable layer may begin to sinter together. This will be the case in particular if the wear lining has already worn away to a considerable extent and there is a risk of liquid iron penetrating through to the deformable layer. The fact that this material sinters together then prevents liquid iron from being able to penetrate through to the permanent lining.

It should be noted that various previous attempts to provide external cooling for the permanent lining have not met with success. Such cooling arrangements on the outside of the steel casing have made it difficult to avoid considerable temperature differences over the surface of the trough. These result in considerable local deformations to the casing. Providing cooling behind the steel casing now prevents irregular cooling of this casing causing deformation to the latter.

From the patent specification U.S. Pat. No. 4,508,323 a runner construction with watercooling of the permanent lining is known, in which further the runner has not been constructed within a steel casing but within a depression in a reinforced concrete foundation. The use of a steel casing has many advantages over this known construction. There can be mentioned the possibility to construct the runner more quickly, the possibility of prefabricating it elsewhere, a better approach from all sides and the possibility to mount the runner movable. In the latter case the possibility is obtained to compensate for thermal expansion in a lengthwise direction. A further advantage of the novel runner construction compared with the said known runner construction consists in that the canals are designed for the transport of a gaseous cooling medium. Compared to the known construction with water-cooling this provides an increased safety against the danger of an explosion in case of a breakthrough of liquid iron through the refractory lining of the runner.

The ducts may be formed in order to provide local cooling of part of the steel casing.

However, it is preferable, according to the invention, for the ducts to run in the longitudinal direction of the runner. In this case, it is only necessary to provide means for supplying and removing the cooling medium at the ends of the runner.

According to another preferred embodiment, the ducts run in the vertical direction in the side walls of the permanent lining.

The benefit of the novel structure can be increased further, according to the invention, if the permanent lining, at least in an outer layer, comprises a layer of refractory cast concrete made from a material which has a relatively high thermal conductivity, where $\lambda$=4 to 7 W/m$^2$.° K., in which outer layer the ducts are provided, by casting in steel pipes. The result of the relatively high thermal conductivity of this outer layer is that, despite the fact that cooling is localized around the pipes, this outer layer is nevertheless at an equal, low temperature. This prevents an uneven temperature distribution in the steel casing, which could cause the latter to become deformed.

Iron runners are situated on the pouring platform of a blast furnace, where heavy tools are often used. In this case, there is a risk of mechanical damage from outside the steel casing, which again may cause damage to the permanent lining. It has been found that this risk can be reduced considerably if at least the side walls of the permanent lining are provided with steel anchors which are attached to the steel casing. This provides a very strong, monolithic structure which is well able to withstand external influences.

If the wear lining has been considerably worn away, the temperature inside the permanent lining will nevertheless begin to increase. It is therefore preferred to make that part of the permanent lining which lies inside the outer layer of relatively high thermal conductivity from a high-grade refractory material. In this case, consideration may be given, for example, to a refractory concrete with a high $Al_2O_3$ content.

Air, may be considered for the cooling medium which flows through the ducts. It has been found that good results can be achieved by connecting the ducts to a system for forced air cooling.

According to another embodiment, one end of each of the ducts is connected to a stack of sufficient height to maintain a natural draught through the ducts.

BRIEF DESCRIPTION OF THE DRAWINGS

The invention will be explained in more detail with reference to a figure.

This figure shows a diagrammatic, cross-sectional view of a structure of an iron runner, which is denoted by reference 1, in a blast furnace. The passage formed by this runner is of tapering shape; in the case illustrated, this passage is approximately 900 mm wide at the bottom and the inclined walls run at an angle of 9° with respect to the vertical. However, it should be noted that these dimensions are not essential for providing an understanding of the invention and may be selected to be different for every blast furnace installation.

Figure 1:
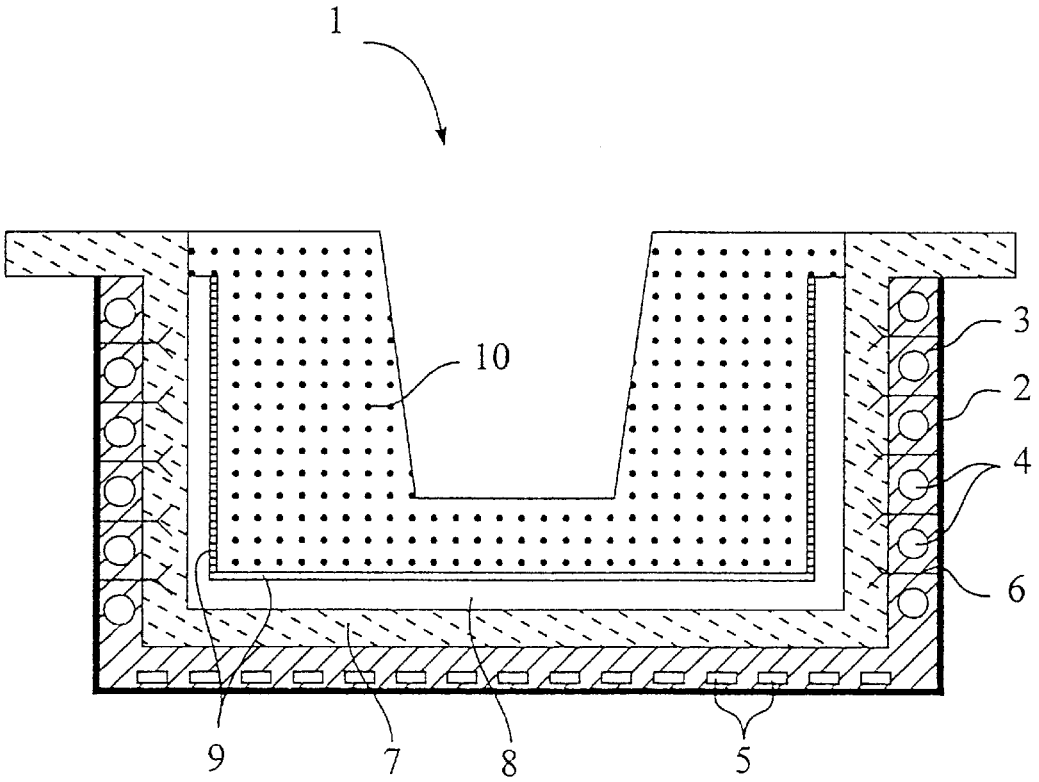

The runner is formed inside a steel casing 2, which itself is in the form of an elongate trough. If appropriate, the steel casing 2 may be provided on the inside with a lining of thermally insulating material. The length of such a runner structure may, depending on the local situation, be approximately 12 to 20 m.

Inside the steel casing 2, there is firstly an outer layer of refractory material 3 with a relatively high thermal conductivity, where $\lambda$=4 to 7 $W/m^2.°$ K. This layer may, for example, highly expediently comprise a cast concrete based on SiC. In this layer 3, in the case illustrated, a number of ducts 4 with round cross section run through the side walls and a number of ducts 5 with rectangular cross section run along the bottom. However, ducts 5 may also be of round or square cross section. The ducts 4 are formed by thick-walled steel pipes which are cast into the cast concrete material.

Preferably, the pipes have previously been provided with a layer of paint, paraffin or some other agent which prevents it from adhering to the concrete. It is also necessary to ensure that the pipes 4 or 5 are not confined at the runner ends. This allows the pipes to expand as a result of the effects of temperature.

The pipes which form the ducts 5 are laid freely on the bottom of the steel casing and are preferably separated from the latter by a thin insulating layer, for example a layer of refractory felt.

On the inside of layer 3, there is a layer of refractory material 7 which comprises a refractory concrete with a high $Al_2O_3$ content. This provides a strongly refractory material.

A number of anchors 6, which extend through layer 3 into layer 7, are welded to the side walls of the steel casing 2. The result is a strong, monolithic unit forming the assembly comprising the steel casing 2 and the layers 3 and 7. Together, the layers 3 and 7 form the permanent lining of the runner structure.

With regard to the further structure of the runner, solid slabs 9 are firstly temporarily anchored at a distance from layer 7, with a clear gap being left between the slabs 9 and the layer 7. This gap is filled up either with a granular refractory material which is slightly rammed or with refractory felt. The layer 8 formed in this way can serve as an expansion joint and as a sliding joint for absorbing thermal expansions. The preformed slabs 9 may comprise prefabricated concrete slabs. The composition of these slabs is not critical. They may, inter alia, comprise refractory concrete with a high $Al_2O_3$ content, but may also comprise compressed refractory material which contains carbon or graphite. Furthermore, a conventional refractory cast concrete, which is provided with the shape of block 10 by a mould, is arranged inside these slabs 9.

The layers 3 and 7 form the permanent lining of the runner structure, while the layers 8, 9 and 10 may be regarded as the wear lining. As block 10 wears away further, the temperature of the material in layer 8 will be able to rise further, and in the long term the material will begin to sinter together. This may be regarded as an advantage, since it prevents iron which has broken through block 10 and slabs 9 from being able to penetrate further through layer 8, with the result that the permanent lining is not affected.

The ducts 4 and 5 are connected to a system for forced air cooling (not shown). Consideration may be given, for example, to a ventilator, the outlet duct of which is connected, via a manifold, to each of the ducts 4 and 5.

What is claimed is:

1. Runner for guiding a flow of liquid metal and/or slag, comprising a refractory permanent lining, a refractory wear lining inside the refractory permanent lining, and an elongate steel casing shaped as a trough, wherein the permanent lining is arranged inside the elongate steel casing shaped as a trough, the permanent lining having opposed side walls extending from a bottom wall, wherein parallel ducts, through which a gaseous cooling medium is passed, run through the side walls and the bottom wall of this permanent lining divided along the perimeter of the permanent lining in the vicinity of the bottom and the side walls of the steel casing, and wherein the wear lining and the permanent lining are separated from one another by a deformable layer which is made from a member of the group of materials consisting of dry refractory ramming mixture and refractory felt.

2. A runner according to claim 1, wherein the ducts run in the longitudinal direction of the runner.

3. A runner according to claim 1, wherein the ducts run in the vertical direction in the side walls of the permanent lining.

4. A runner according to claim 1, wherein the permanent lining, at least in an outer layer, comprises a layer of refractory cast concrete made from a material which has a relatively high thermal conductivity, where $\lambda$=4 to 7 $W/m^2.°$ K., in which outer layer the ducts are provided, by casting in steel pipes.

5. A runner according to one of claim 1, wherein at least the side walls of the permanent lining are provided with steel anchors which are attached to the steel casing.

6. A runner according to claim 1, wherein the permanent lining, on the inside of the outer layer which has the relatively high $\lambda$, comprises high-grade refractory material.

7. A runner according to claim 1, wherein the ducts are connected to a system for forced air cooling.

8. A runner according to claim 1, wherein one end of each of the ducts is connected to a stack of sufficient height to maintain a natural draught through the ducts.

9. Runner for guiding a flow of liquid metal and/or slag, comprising a refractory permanent lining and, inside the latter, a refractory wear lining, wherein the permanent lining is arranged inside an elongate steel casing shaped as a trough, wherein parallel ducts through which a gaseous cooling medium is passed run through this permanent lining divided along the circumference in the vicinity of the bottom and the walls of the steel casing, and wherein the wear lining and the permanent lining are separated from one another by a deformable layer which is made from a member of the group of materials consisting of dry refractory ramming mixture and refractory felt, wherein one end of each of the ducts is connected to a stack of sufficient height to maintain a natural draught through the ducts.

* * * * *